US005195585A

United States Patent [19]

Clemens et al.

[11] Patent Number: 5,195,585

[45] Date of Patent: Mar. 23, 1993

[54] WIRELINE RETRIEVABLE JET CLEANING TOOL

[75] Inventors: Jack G. Clemens, Plano; John H. Yonker, Carrollton; Stewart H. Fowler, Plano; Charles C. Cobb, Frisco; William G. Boyle, Dallas, all of Tex.

[73] Assignee: Otis Engineering Corporation, Dallas, Tex.

[21] Appl. No.: 732,054

[22] Filed: Jul. 18, 1991

[51] Int. Cl.[5] ..... E21B 37/00

[52] U.S. Cl. ..... 166/222; 166/312; 175/424

[58] Field of Search ..... 166/222, 223, 902, 312; 175/424

[56] References Cited

U.S. PATENT DOCUMENTS

| | | | |
|---|---|---|---|
| 3,712,378 | 1/1973 | Olivier | 166/311 X |
| 4,431,057 | 2/1984 | Colonna et al. | 166/222 X |
| 4,518,041 | 5/1985 | Zublin | 166/222 X |
| 4,799,554 | 1/1989 | Clapp et al. | 166/312 |
| 4,919,204 | 4/1990 | Baker et al. | 166/223 |

*Primary Examiner*—Terry Lee Melius

*Attorney, Agent, or Firm*—Ross, Howison, Clapp & Korn

[57] ABSTRACT

A wireline retrievable jet cleaning tool (10) comprising an adapter axle (12), a longitudinally extending axle (16), and a nozzle housing (14) rotatably mounted around the axle (16), the nozzle housing having at least two longitudinally spaced-apart nozzle sections (18A, 18B) adapted to sweep jets of cleaning fluid over longitudinally spaced target areas in a well tool or tubular, each nozzle section (18A, 18B) preferably having at least one tangentially directed nozzle (44), at least one radially directed nozzle (48) and at least one obliquely directed nozzle (52). A longitudinally reciprocating jet cleaning tool (60) comprising a rotatable nozzle housing (64) adapted to rotate around and slide longitudinally along a fixed axle (66) responsive to increased fluid pressures is also provided.

19 Claims, 3 Drawing Sheets

WIRELINE RETRIEVABLE JET CLEANING TOOL

BACKGROUND OF THE INVENTION

1. Field of the Invention

This invention relates to the servicing of wells by use of wireline retrievable equipment, and more particularly, to a wireline retrievable apparatus that is useful for removing scale and other downhole deposits from the inside of well tubulars or tools such as, for example, subsurface safety valves, nipples, sliding sleeves, and orienting shoes in side pocket mandrels.

2. Description of Related Art

The use of general purpose, fluid-powered cleaning tools for removing scale and other deposits from the inside diameter of well tubulars has previously been disclosed, for example, in U.S. Pat. Nos. 4,799,554 and 4,919,204.

U.S. Pat. No. 4,799,554 discloses a cleaning apparatus adapted to be deployed in a well conduit on the end of reeled or coil tubing that is injected into a well. Cleaning fluid is pumped down the reeled tubing, through the apparatus, and outward through a plurality of jet nozzles in the head of the cleaning tool. A system of springs, control slots and indexing pins cooperates with ratchet teeth to provide limited relative longitudinal and rotational movement between concentrically positioned mandrels in response to changes in the pressure at which cleaning fluid is pumped through the apparatus.

U.S. Pat. No. 4,919,204 discloses another cleaning apparatus adapted for deployment inside a well on reeled tubing. The apparatus comprises a non-rotating inner mandrel adapted to receive cleaning fluid pumped down through the reeled tubing, a housing rotatably mounted on the exterior of the inner mandrel, and a nozzle body attached to the housing. Fluid pressure flowing through the inner mandrel causes the housing to rotate relative to the inner mandrel, and the rotation is used to direct fluid jets towards different portions of the interior of a flow conductor. A wireline retrievable jet cleaning tool is needed, however, that is adapted to be powered by fluid pumped downward through the production tubing rather than through reeled tubing as previously disclosed.

When tubing-retrievable, surface controlled subsurface safety valves such as those disclosed in U.S. Pat. No. 4,945,993 are used in wells, problems are sometimes encountered due to the presence of scale, corrosion byproducts, mineral deposits and the like that foul or otherwise impair the operability of the lockout sleeves, operating sleeves, pistons or ball mechanisms of the valves. In such instances, a wireline retrievable, fluid-powered, jet cleaning tool is needed that can be suspended from a support member above or inside the safety valve, that can simultaneously clean a plurality of longitudinally spaced target areas within the valve, and that can be rotated fully to facilitate cleaning of the entire inside circumference of the valve.

A reciprocating jet cleaning tool is also needed that can be deployed by wireline equipment inside well tools or tubulars, and that comprises longitudinally spaced nozzle sections, each of which is adapted to sweep jets of a pressurized cleaning fluid both longitudinally and circumferentially over a predetermined target area inside the well tools or tubulars.

SUMMARY OF THE INVENTION

According to the present invention, a jet cleaning tool is provided that comprises a rotatable nozzle assembly having a plurality of longitudinally spaced nozzle sections adapted to sweep jets of pressurized cleaning fluid over predetermined longitudinally spaced target areas on the inside circumference of a subsurface safety valve or other well tool or tubular.

According to one preferred embodiment of the invention, a wireline retrievable jet cleaning tool is provided that comprises a stationary, longitudinally extending axle; means for connecting the axle to a landing nipple; a nozzle housing adapted to rotate coaxially around the axle, the nozzle housing comprising at least two longitudinally spaced nozzle sections, each nozzle section having a plurality of outwardly directed nozzles; and means for providing fluid communication through the axle and nozzle housing to the nozzles in each nozzle section. According to a particularly preferred embodiment of the invention, each nozzle section preferably comprises at least one pair of diametrically opposed, tangentially directed nozzles adapted to cause rotation of the nozzle housing around the axle; and at least one pair of diametrically opposed, radially and/or obliquely directed nozzles adapted to sweep a target area on the inside circumference of a well tool or tubular.

The apparatus of the invention is preferably adapted to sweep jets of cleaning fluid over predetermined target areas inside a well bore during rotation of the nozzle housing about the axle, which rotation is caused by cleaning fluid being expelled under pressure through at least one nozzle oriented so as to have a tangential component.

According to another preferred embodiment of the invention, a wireline retrievable jet cleaning tool is provided that comprises an adapter axle adapted to be connected to a support member or other hold-down means; an axle connected in fixed coaxial relation beneath the adapter axle; a nozzle housing adapted to rotate coaxially around the axle, the nozzle housing further comprising a plurality of longitudinally spaced nozzle sections, each nozzle section having a plurality of longitudinally and circumferentially spaced nozzles, with at least some of the nozzles being oriented so as to cause the nozzle housing to rotate around the axle whenever pressurized fluid is forced outwardly through the nozzles; and means for establishing fluid communication through the adapter axle, and between the adapter axle and the nozzles.

According to another embodiment of the invention, a reciprocating jet cleaning tool is also provided that can be deployed by wireline equipment inside well tools or tubulars, and that comprises longitudinally spaced nozzle sections, each of which is adapted to sweep jets of a pressurized cleaning fluid both longitudinally and circumferentially over a predetermined target area inside the well tool or tubular. According to one preferred embodiment of the invention, the subject jet tool comprises a rotatable nozzle housing adapted to slide longitudinally along a concentrically disposed axle whenever sufficient fluid pressure is supplied to the tool to overpressure biasing means within the tool.

BRIEF DESCRIPTION OF THE DRAWINGS

The apparatus of the invention is further described and explained in relation to the following figures of the drawings wherein.

DESCRIPTION OF THE PREFERRED EMBODIMENTS

Figure 1:
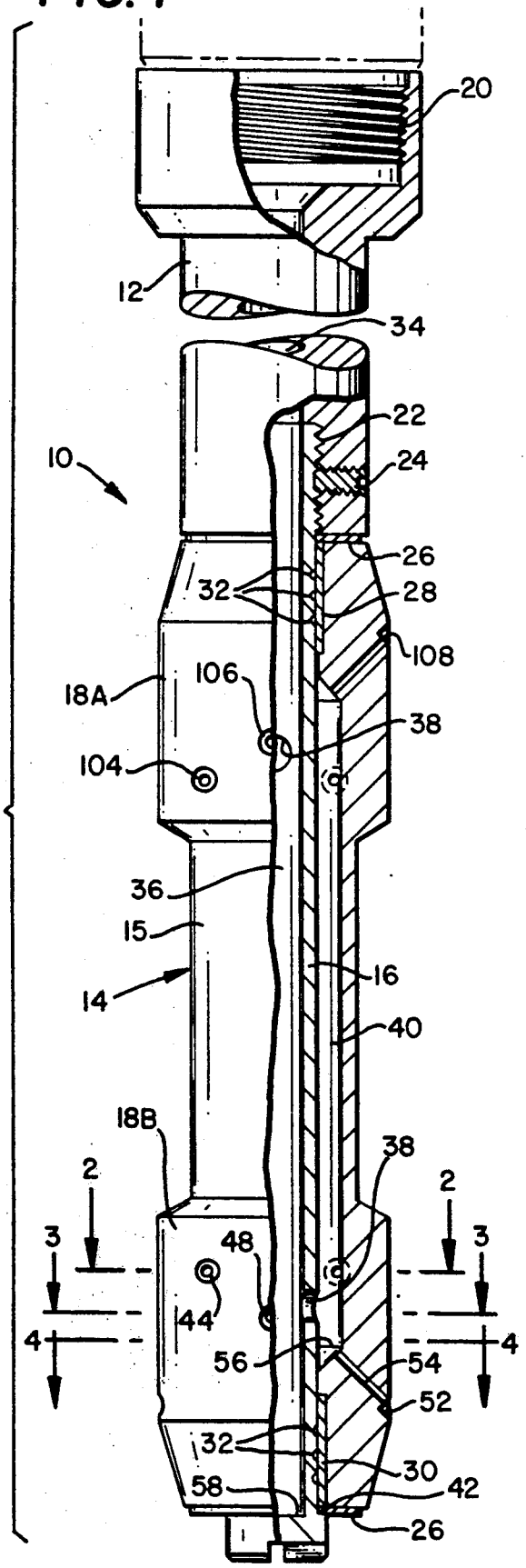
FIG. 1 is an elevation view, partially broken away and partially in section, of a preferred embodiment of the jet cleaning tool of the invention.

Referring to FIG. 1, jet cleaning tool 10 preferably comprises adapter axle 12, nozzle housing 14 and axle 16. Adapter axle 12 is preferably connected by threads 20 to the lower end of a support member (partially shown in phantom outline) or other hold-down means. While the apparatus disclosed herein is useful for cleaning and descaling the interior-facing surfaces of many types of well tools and tubulars, a preferred use for the apparatus is cleaning the inside surfaces of tubing retrievable subsurface safety valves.

The length of adapter axle 12 is preferably such that whenever the support member is locked into a profile inside the production string, nozzle housing 14 is disposed adjacent to the target area intended to be cleaned. The length of adapter axle 12 can therefore vary, depending upon the longitudinal spacing between the profile and the desired target area. As used herein, the term "target area" means any longitudinally and/or circumferentially extending zone within a tool or tubular that needs cleaning, descaling, or removal of an obstruction that might otherwise impair satisfactory operation of equipment deployed in a well. Mineral deposits, sand bridges, corrosion byproducts, cement, and the like, are merely examples of deposits that can often be satisfactorily removed through use of the apparatus of the invention.

Axle 16 is preferably a tubular metal member having its upper end connected by threads 22 to matching threads in the lower end of adapter axle 12. Set screw 24 is desirably provided to limit relative rotational movement between adapter axle 12 and axle 16. Axle 16 preferably further comprises interior longitudinal bore 36, which is coaxially aligned with bore 34 of adapter axle 12. At its lower end, longitudinal bore 36 terminates at end wall 58.

Nozzle housing 14 is concentrically disposed around axle 16, and is rotatably mounted with respect to axle 16 by means of thrust bearings 26 and journal bearings 28, 30. Shoulder 42 is provided at the lower end of axle 16 to prevent nozzle housing 14 from sliding off the axle. During assembly, nozzle housing 14 is first slipped over the upper end of axle 16, and axle 16 is then threaded into the lower end of axle adapter 12. Nozzle housing 14 preferably further comprises a longitudinally extending annular chamber 40. Radial flow ports 38 of axle 16 provide fluid communication between longitudinal bore 36 of axle 16 and annular chamber 40 of nozzle housing 14. A labyrinth seal comprising a plurality of small annular grooves 32 is preferably provided around the outside of axle 16 opposite journal bearings 28, 30. Grooves 32 provide a tortuous or turbulent flow path which results in a limited flow rate or controlled leak rate. The controlled leak rate cooperates with the adjacent bearing surface to provide a fluid "cushion."

The exterior of nozzle housing 14 preferably comprises upper and lower nozzle sections 18A, 18B, respectively, that are longitudinally separated by cylindrical section 15. As shown in FIG. 1, the outside diameter of cylindrical section 15 is stepped radially inward from upper and lower nozzle sections 18A, 18B to reduce the weight of the apparatus. Where the outside diameter of upper and lower nozzle sections 18A, 18B is such that there is little radial clearance between the nozzle sections and the target area, the reduced diameter of cylindrical section 15 also provides a place for solid material washed from the target area to accumulate. The length of upper and lower nozzle sections 18A, 18B and the longitudinal spacing between them can vary, depending upon the size and spacing of the target area in the well tool or tubular being cleaned. For example, for use in cleaning in a tubing retrievable subsurface safety valve, nozzle housing 14 might be sized so that upper nozzle section 18A is disposed opposite the lockout mechanism and lower nozzle section 18 is disposed opposite the piston area whenever jet cleaning tool 10 is locked in place. Alternatively, more than two nozzle sections can be longitudinally spaced apart in one nozzle housing 14 if desired for simultaneously cleaning more than two longitudinally spaced target areas.

Each nozzle section comprises at least one fluid spray nozzle, and preferably, a plurality of sets of fluid spray nozzles. During operation of jet cleaning tool 10, cleaning fluid is preferably pumped downward through the production tubing; through the support member or other hold-down means; through adapter axle 12 and axle 16; radially outward through radial flow ports 38 in axle 16 into annular chamber 40; and out of annular chamber 40 through the nozzles disposed in nozzle sections 18A, 18B. The composition of cleaning fluids useful in the apparatus of the invention can vary widely, but generally comprises an aqueous fluid containing various amounts of additives such as water soluble polymers used for reducing friction or viscosity. The cleaning fluids may include nitrogen or a mixture of nitrogen and water with chemical additives to produce foam. While the pressures at which the cleaning fluid is pumped through jet cleaning tool 10 can vary according to factors such as the size and placement of the nozzles relative to the target area, the structure of the well tool or tubular being cleaned, the physical properties of the cleaning fluid, the desired rotation rate, and the nature of the material to be removed during cleaning, operating pressures in the range of 3000 to 5000 psi are preferred.

Figure 2:
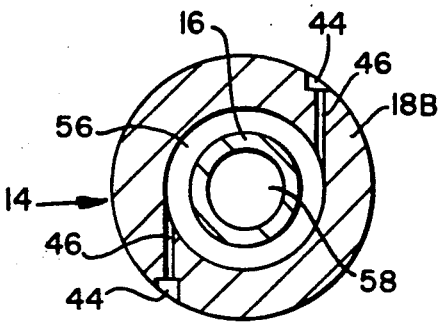
FIG. 2 is a cross-sectional view taken along line 2—2 of FIG. 1.

According to a particularly preferred embodiment of the invention, as shown in FIGS. 1–4, each one of nozzle sections 18A, 18B comprises at least three separate sets of diametrically opposed nozzles, with at least one set being adapted to direct the cleaning fluid in each of three separate directions: tangentially; radially; and obliquely. Referring to FIGS. 1 and 2, tangential nozzles 44 in nozzle section 18B communicate with annular chamber 40 through tangential passageways 46. Because tangential nozzles 44 expel cleaning fluid from nozzle housing 14 along an axis that is normal to, but radially offset from, the longitudinal axis through nozzle housing 14 and axle 16, the expulsion of cleaning fluid through these nozzles causes nozzle housing 14 to rotate in a clockwise (when viewed as shown in FIG. 2) direction around axle 16. In addition to imparting rotational motion to nozzle housing 14, tangential nozzles 44 also facilitate cleaning as the fluid jets expelled through them sweep the inside surface of a well tool or tubular. Although only one pair of diametrically opposed tangential nozzles 44 is shown in FIG. 2, it should be understood that a plurality of sets of tangential nozzles 44 can be provided in each nozzle section. Tangential nozzles 104 in nozzle section 18A correspond to tangential nozzles 44 in nozzle section 18B.

Figure 3:
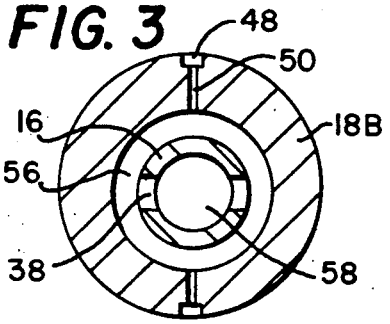
FIG. 3 is a cross-sectional view taken along line 3—3 of FIG. 1.

Referring to FIGS. 1 and 3, radial nozzles 48 in nozzle section 18B communicate with annular chamber 40 through radial passageways 50. Radial nozzles 48 are adapted to spray the cleaning fluid directly against the surface of the well tool or tubular being cleaned, and like the other nozzles, will sweep the target area circumferentially as nozzle housing 14 rotates around axle 16. Radial nozzles 106 in nozzle section 18A correspond to radial nozzles 48 in nozzle section 18B. Although only one pair of radial nozzles is shown in each of nozzle sections 18A, 18B, it is understood that a plurality of longitudinally spaced sets of radial nozzles can be provided in each nozzle section.

Figure 4:
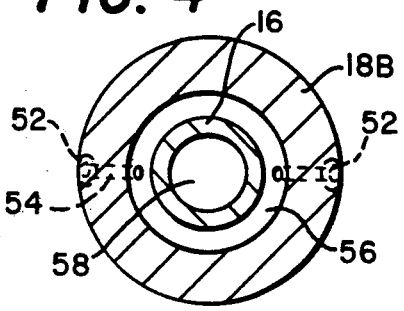
FIG. 4 is a cross-sectional view taken along line 4—4 of FIG. 1.

Referring to FIGS. 1 and 4, oblique nozzles 52 are preferably provided in nozzle section 18B to extend the longitudinal reach over which nozzle section 18B can clean. Oblique nozzles 108 in nozzle section 18A correspond to oblique nozzles 52 in nozzle section 18B. If desired for some applications, oblique nozzles can also be downwardly directed from nozzle section 18A and upwardly directed from nozzle section 18B to sweep a target area opposite intermediate cylindrical section 15 of nozzle housing 14 if desired.

While sets of nozzles comprising diametrically opposed nozzle pairs are preferred for use in the subject nozzle sections, it will be appreciated that other geometric arrangements of nozzles can also be used satisfactorily, although such arrangements will preferably be balanced circumferentially. By way of example, sets of nozzles comprising three nozzles spaced 120 degrees apart around the circumference of nozzle housing 14 can also be used. Nozzle spacing should be selected to provide optimum cleaning efficiency depending upon the type of downhole deposit and the configuration of the downhole equipment.

Figure 5:
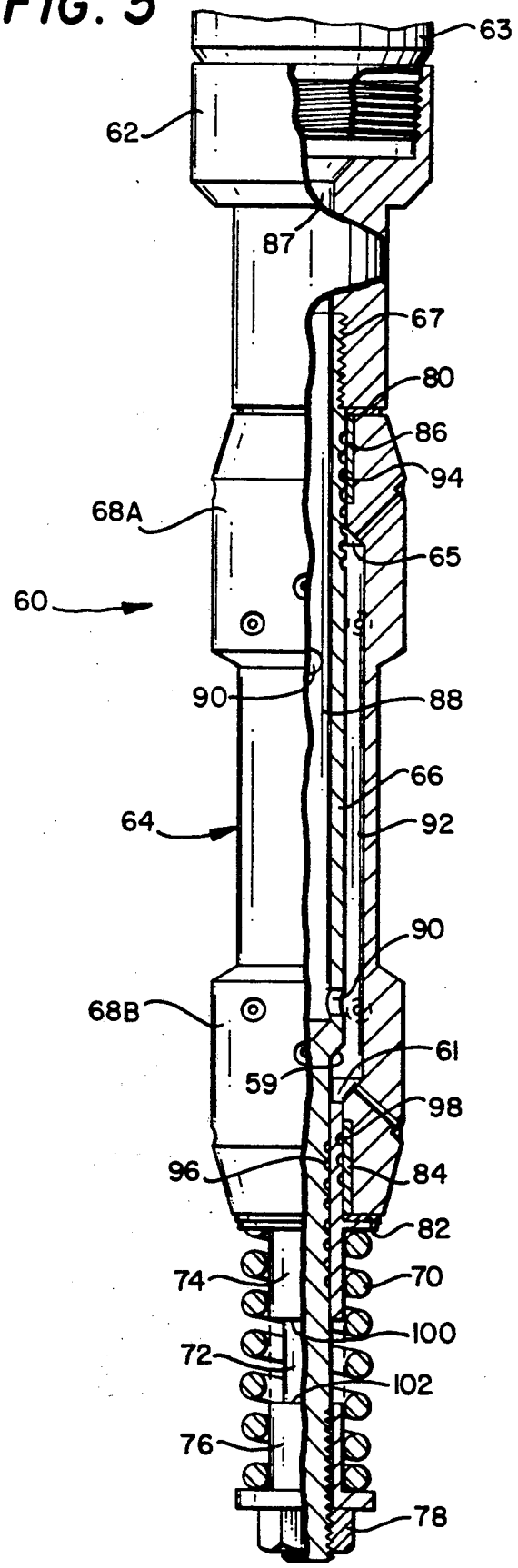
FIG. 5 is an elevation view, partially broken away and partially in section, of a preferred embodiment of the reciprocating jet cleaning tool of the invention.
Figure 6:
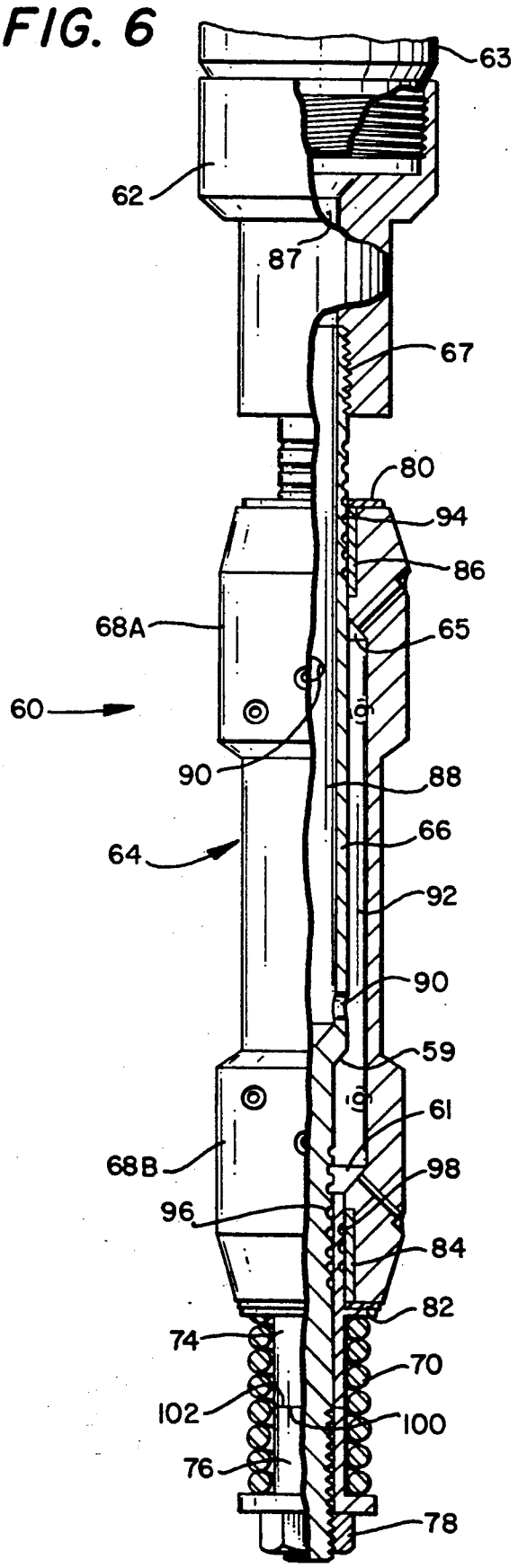
FIG. 6 is an elevation view, partially broken away and partially in section, of the preferred reciprocating jet cleaning tool of FIG. 5 in which fluid pressure has overpressured and compressed the spring, causing the nozzle sections to sweep the target area longitudinally as well as circumferentially.

Another embodiment of the invention, described in relation to FIGS. 5 and 6, comprises a rotatable, longitudinally reciprocating nozzle housing. Use of the embodiment shown in FIGS. 5 and 6 will facilitate sweeping target areas with jets of cleaning fluid both circumferentially and longitudinally by varying the fluid pressure.

Referring to FIG. 5, jet cleaning tool 60 preferably comprises adapter axle 62, nozzle housing 64, and axle 66. Axle 66 is connected to adapter axle 62 by threads 67, and although not shown in FIG. 5, a set screw as previously described in relation to the embodiment shown in FIG. 1 or other similarly effective means can be provided to maintain axle 66 in a fixed position relative to adapter axle 62 after assembly. Adapter axle 62 preferably threadedly engages and is suspended from support member 63. Adapter axle 62 and nozzle housing 64 are substantially identical to adapter axle 12 and nozzle housing 14 previously described in relation to jet cleaning tool 10 of FIG. 1.

Nozzle housing 64 further comprises longitudinally spaced nozzle sections 68A, 68B, and is rotatably mounted onto axle 66 using thrust bearings 80, 82 and journal bearings 86, 84, respectively. A plurality of radial flow ports 90 provide fluid communication between longitudinal bore 88 of axle 66 and longitudinally extending annular chamber 92 of nozzle housing 64. Cleaning fluid is delivered to bore 88 of axle 66 through bore 87 of adapter axle 62. A plurality of small-diameter annular grooves 94 is preferably provided near the top end of the outwardly facing surface of axle 66 to receive and trap fluid for reducing friction as nozzle housing 64 rotates around axle 66 during use. A plurality of nozzles are preferably provided in each of nozzle sections 68A, 68B as previously described in relation to nozzle sections 18A, 18B of jet cleaning tool 10.

Below nozzle housing 64, axle 66 preferably comprises lower shaft 72, which is threaded at its lower end to receive nut 78. Upper and lower spring guides 74, 76, respectively, each comprise a sleeve portion that slidably engages lower shaft 72, and a radially extending flange portion adapted to confine a biasing means such as coil spring 70 therebetween. The cylindrical sleeve portion of upper spring guide 74 preferably extends upwardly past the flange portion between axle 66 and journal bearing 84. Annular grooves 98 are preferably provided in the outwardly extending surface of the upwardly directed sleeve portion of upper spring guide 74 to create a labyrinth seal that reduces friction during rotation of nozzle housing 64. Annular grooves 96 are likewise preferably provided in the outwardly extending surface of that portion of axle 66 disposed radially inward of upper spring guide 74 to create a labyrinth seal and thereby reduce friction as upper spring guide 74 slides back and forth over lower shaft 72. Other types of seals and bearings could be used with this invention in addition to the labyrinth seals and journal bearings shown in FIGS. 1, 5 and 6.

When jet cleaning tool 60 is not in use, or when it is being used at relatively low fluid pressures, coil spring 70 biases nozzle housing 64 upwardly against adapter axle 62. During operation of jet cleaning tool 60, pressurized cleaning fluid is pumped downwardly through bore 87 in adapter axle 62; through longitudinal bore 88 of axle 66; through radial flow ports 90 into annular chamber 92 of nozzle housing 64; and outwardly through the nozzles in each of nozzle sections 68A, 68B.

Referring to FIG. 6, the diameter of axle 66 is stepped radially inward at beveled shoulder 59 above lower shaft 72. This reduction in the diameter of axle 66 creates a greater cross-sectional area at lower end 61 of annular chamber 92 than at upper end 65. This differential area causes a greater pressure to be exerted in the downward direction whenever fluid is injected into annular chamber 92. When the fluid pressure is increased sufficiently to overpressure coil spring 70, rotating nozzle housing 64 will simultaneously slide downwardly over axle 66, causing the fluid jets from the nozzles in nozzle sections 68A, 68B to sweep the target area longitudinally as well as circumferentially. Preferably, the fluid pressure is increased gradually to provide balanced, continuous cleaning over the longitudinal range of travel of nozzle housing 64. The range of travel is limited by the longitudinal spacing between lower shoulder 100 of upper spring guide 74 and upper shoulder 102 of lower spring guide 76. The position of nozzle housing 64 relative to adapter axle 62 when coil spring 70 is compressed to the point where shoulder 100 contacts shoulder 102 is shown in FIG. 6.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

We claim:

1. A jet cleaning tool for simultaneously cleaning a plurality of longitudinally spaced target areas comprising a stationary, longitudinally extended axle; means for connecting the axle to a support member; a nozzle housing rotatable around the axis inside a well tubular, the nozzle housing comprising at least two longitudinally spaced nozzle sections, each nozzle section having at least one fluid spray nozzle directed against the wall of the well tubular; and means for providing fluid communication for a pressurized fluid through the axle and nozzle housing to each fluid spray nozzle in each nozzle section, thereby directing fluid to each target area.

2. The jet cleaning tool of claim 1 wherein each nozzle section comprises at least one tangentially directed nozzle, the nozzle housing being adapted to rotate coaxially around the axle whenever a pressurized fluid is expelled through the tangentially directed nozzles.

3. The jet cleaning tool of claim 2 wherein each nozzle section comprises at least one radially directed nozzle.

4. The jet cleaning tool of claim 2 wherein each nozzle section comprises at least one obliquely directed nozzle.

5. The jet cleaning tool of claim 1 wherein the longitudinally spaced nozzle sections are separated by a cylindrical sleeve section having a reduced diameter.

6. The jet cleaning tool of claim 1, further comprising means for reciprocating the nozzle housing longitudinally along the axle responsive to pressure variations in the pressurized fluid.

7. A jet cleaning tool comprising a stationary, longitudinally extending axle; means for connecting the axle to a support member; a nozzle housing adapted to rotate coaxially around the axle, the nozzle housing comprising at least two longitudinally spaced nozzle sections, each nozzle section having at least one outwardly directed nozzle; means for providing fluid communication for a pressurized fluid through the axle and nozzle housing to the nozzles in each nozzle section; and means for reciprocating the nozzle housing longitudinally along the axis responsive to pressure variations in the pressurized fluid.

8. A wireline retrievable jet cleaning tool for simultaneously cleaning a plurality of longitudinally spaced, predetermined target area inside well tools and tubulars, the jet cleaning tool comprising a longitudinally extending axle, a nozzle housing rotatably mounted around the axle, and means for providing fluid communication through the axle and nozzle housing, the nozzle housing further comprising a plurality of longitudinally spaced nozzle sections, each nozzle section comprising at least one circumferentially rotatable fluid spray nozzle for sweeping at least one jet of a pressurized cleaning fluid circumferentially over each of the target areas.

9. The jet cleaning tool of claim 8, further comprising means for connecting the axle to a support member.

10. The jet cleaning tool of claim 9 wherein said means for connecting the axle to the support member is an adapter axle having a length sufficient to position the nozzle housing opposite at least a portion of the target area.

11. The jet cleaning tool of claim 8 wherein each nozzle section further comprises a plurality of fluid spray nozzles, at least one nozzle being tangentially directed.

12. The jet cleaning tool of claim 11 wherein at least one nozzle is radially directed.

13. The jet cleaning tool of claim 11 wherein at least one nozzle is obliquely directed.

14. The jet cleaning tool of claim 8 wherein the nozzle housing further comprises means for sweeping jets of the pressurized cleaning fluid longitudinally over each of the target areas.

15. The jet cleaning tool of claim 15 wherein the means for sweeping jets of the pressurized cleaning fluid over the target areas further comprises a fixed longitudinal shaft member extending below and slidably engaging the nozzle housing, upper and lower cylindrical guide members slidably engaging the shaft member below the nozzle housing, spring means disposed between the guide members to bias the guide members longitudinally apart, the nozzle housing being adapted upon provision of the cleaning fluid at a sufficient pressure to overpressure the spring means and force the upper spring guide toward the lower spring guide against the bias.

16. A wireline retrievable jet cleaning took for simultaneously cleaning a plurality of longitudinally spaced, predetermined target areas inside well tools and tubulars, the jet cleaning tool comprising a longitudinally extending axle, a nozzle housing rotatably mounted around the axle, and means for providing fluid communication through the axle and nozzle housing, the nozzle housing further comprising a plurality of longitudinally spaced nozzle sections, each nozzle section being adapted to sweep at least one jet of a pressurized cleaning fluid circumferentially over each of the target areas and means for sweeping jets of the pressurized cleaning fluid longitudinally over each of the target areas, said means for sweeping jets of the pressurized cleaning fluid over the target areas comprising a fixed longitudinal shaft member extending below and slidably engaging the nozzle housing, upper and lower cylindrical guide members slidably engaging the shaft member below the nozzle housing, spring means disposed between the guide members to bias the guide members longitudinally apart, the nozzle housing being adapted upon provision of the cleaning fluid at a sufficient pressure to overpressure the spring means and force the upper spring guide toward the lower spring guide against the bias.

17. A jet cleaning tool adapted for deployment by wireline equipment inside a well tool or tubular, the tool comprising:

a nozzle housing having a plurality of longitudinally spaced nozzle sections, each section comprising means for receiving a pressurized cleaning fluid, forming jets of the fluid and sweeping the jets both longitudinally and circumferentially over longitudinally spaced-apart target areas inside the well tool or tubular; and means for longitudinally reciprocating the nozzle housing responsive to pressure variations in the pressurized fluid.

18. The tool of claim 17 comprising a rotatable nozzle housing, a concentrically disposed axle and a biasing means exerting pressure on the nozzle housing, the nozzle housing being adapted to slide longitudinally along the concentrically disposed axle whenever sufficient fluid pressure is supplied to the tool to overpressure the biasing means.

19. A longitudinally reciprocating jet cleaning tool adapted to deployment by wireline equipment inside a well tool or tubular, the tool comprising: a rotatable nozzle housing, a concentrically disposed axle and a biasing means exerting pressure on the nozzle housing, a plurality of longitudinally spaced nozzle sections within the nozzle housing, each nozzle section being adapted to sweep jets of a pressurized cleaning fluid both longitudinally and circumferentially over longitudinally spaced-apart target areas inside the well tool or tubular the nozzle housing being adapted to slide longitudinally along the concentrically disposed axle whenever sufficient fluid pressure is supplied to the tool to overpressure the biasing means.

* * * * *